US011933145B2

(12) United States Patent
Al-Shammari et al.

(10) Patent No.: US 11,933,145 B2
(45) Date of Patent: Mar. 19, 2024

(54) WASTEWATER CONTAINER FOR GAS WELL PROJECT

(71) Applicant: Saudi Arabian Oil Company, Dhahran (SA)

(72) Inventors: Nayef S. Al-Shammari, Dhahran (SA); Ahmad N. Al-Duaij, Al-Hasa (SA); Khalid A. Al-Saleem, Almubarraz (SA); Abdulrahman G. Al-Harthi, Al-Hasa (SA); Saleh F. Al-Harthi, Al-Hasa (SA); Haitham A. Elgizooli, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 342 days.

(21) Appl. No.: 17/188,556

(22) Filed: Mar. 1, 2021

(65) Prior Publication Data

US 2022/0275710 A1 Sep. 1, 2022

(51) Int. Cl.

| | |
|---|---|
| ***E21B 41/00*** | (2006.01) |
| ***B65D 88/54*** | (2006.01) |
| ***E21B 43/26*** | (2006.01) |
| ***F23G 7/08*** | (2006.01) |
| *B65D 90/00* | (2006.01) |

(52) U.S. Cl.

CPC ..... *E21B 41/0071* (2013.01); *B65D 88/54* (2013.01); *E21B 43/2607* (2020.05); *F23G 7/085* (2013.01); *B65D 90/0006* (2013.01)

(58) Field of Classification Search

CPC .... B65D 81/26; B65D 88/54; B65D 90/0006; F23G 7/06; F23G 7/08; F23G 7/085; E21B 43/25; E21B 43/255; E21B 43/26; E21B 41/0064; E21B 41/0057; E21B 41/005; E21B 41/0071; E21B 43/2607; E21B 43/34

See application file for complete search history.

(56) References Cited

U.S. PATENT DOCUMENTS

| | | | | |
|---|---|---|---|---|
| 6,009,959 | A * | 1/2000 | Dietzen | B63B 27/34 175/207 |
| 6,213,227 | B1 * | 4/2001 | Dietzen | B63B 27/34 175/207 |
| 8,573,303 | B2 | 11/2013 | Kerfoot et al. | |
| 9,353,586 | B2 * | 5/2016 | Mathena | G01V 3/18 |

(Continued)

OTHER PUBLICATIONS

U.S. Appl. No. 60/908,453, Kerfoot et al., filed Mar. 28, 2007.

Cen.acs.org [online], "Wastewater from fracking: Growing disposal challenge or untapped resource?" Nov. 2019, [retrieved on May 12, 2021], retrieved from: URL <https://cen.acs.org/environment/water/Wastewater-fracking-Growing-disposal-challenge/97/i45>, 6 pages.

(Continued)

*Primary Examiner* — Kareen K Thomas

(74) *Attorney, Agent, or Firm* — Fish & Richardson P.C.

(57) ABSTRACT

A wastewater container, or fluid capture tank, for capturing fluid from a flare is provided, along with methods for making and using the fluid capture tank. The fluid capture tank includes an open top tank to hold fluid for disposal, and a flare chute mounted to one end of the open top tank. The flare chute includes three panels, including a bottom panel mounted to a left wall panel and a right wall panel, wherein the three panels direct fluid from a line into the open top tank. A refractory lining is disposed on an inner surface of at least one of the three panels facing the line, wherein the refractory lining protects the inner surface from heat as hydrocarbons in the fluid are burned.

16 Claims, 7 Drawing Sheets

100

(56) References Cited

U.S. PATENT DOCUMENTS

2005/0166759 A1 8/2005 Ross et al.
2011/0005241 A1* 1/2011 Zittel ..... F25D 13/065 62/63
2011/0072980 A1* 3/2011 Maupin ..... A23B 7/158 99/348
2011/0114389 A1 5/2011 Mathena
2013/0025200 A1* 1/2013 Uchiyama ..... C10K 3/023 48/78
2013/0108972 A1* 5/2013 Stangherlin ..... B01D 19/0036 96/155
2014/0311356 A1* 10/2014 Daniels ..... A47J 37/0713 99/340
2015/0232768 A1* 8/2015 Mason ..... C10B 21/00 202/97
2016/0122125 A1* 5/2016 Friesen ..... B65G 65/466 414/304
2017/0144085 A1* 5/2017 Cox ..... B01D 17/0211
2017/0320660 A1* 11/2017 Sanders ..... E21B 43/267
2019/0241356 A1* 8/2019 Schaffner ..... B65G 65/40

OTHER PUBLICATIONS

Hcpetroleum.hk [online], "HC Supplies Fracturing Flowback System for Middle East Project" Dec. 2020, [retrieved on Dec. 10, 2020], retrieved from: URL <https://www.hcpetroleum.hk/news-detail/175>, 4 pages.

Polystarcontainment.com [online], "Hydraulic Fac Tank Spill Prevention" Apr. 2016, [retrieved on Dec. 10, 2020], retrieved from: URL <https://www.polystarcontainment.com/industry/hydraulic-fracturing/>, 6 pages.

SAIP Examination Report in Saudi Arabian Appln. No. 122430736, dated Jun. 17, 2023, 9 pages (with English translation).

* cited by examiner

100

200

300

400

500

600

700

WASTEWATER CONTAINER FOR GAS WELL PROJECT

TECHNICAL FIELD

The present disclosure is directed to capturing fluids from gas wells during flowback operations.

BACKGROUND

The drilling of gas wells is often followed by fracturing to create cracks in a reservoir formation. After fracturing, the well is opened to allow pressurized fluid to flow back to the surface, termed flowback fluid herein. The flowback fluids, often mixed with hydrocarbons from the well, are generally allowed to drop into a burn pit, in which they are flared. However, the flowback fluids accumulate on the surface of the burn pit and contaminate the soil.

Current practices have third-party contractors vacuum accumulated flowback fluid and contaminated soil from the burn pit. This is then sent to a facility for further processing and recycling. However, the continuing use of the burn pit and the possibility of underground leaks creates a high likelihood of environmental contamination.

SUMMARY

An exemplary embodiment described herein provides a fluid capture tank. The fluid capture tank includes an open top tank to hold fluid for disposal, and a flare chute mounted to one end of the open top tank. The flare chute includes three panels, including a bottom panel mounted to a left wall panel and a right wall panel, wherein the three panels direct fluid from a line into the open top tank. A refractory lining is disposed on an inner surface of at least one of the three panels facing the line, wherein the refractory lining protects the inner surface from heat as hydrocarbons in the fluid are burned.

Another exemplary embodiment described herein provides a method for making a fluid capture tank. The method includes forming a flare chute, wherein the flare chute is formed by coupling a bottom panel to a left side panel and coupling the bottom panel to a right side panel. The flare chute is lined with a refractory material. The flare chute is attached to one end of an open top tank to form the fluid capture tank.

Another exemplary embodiment described herein method for using a fluid capture tank to capture fluids from a flowback operation. The method includes positioning a flowback line over a flare chute, wherein the flare chute is mounted at one end of an open top tank. The method includes activating a flare igniter, and opening the flowback line to allow fluid to flow. Hydrocarbons are burned in the flare chute and nonflammable fluid is captured in the open top tank.

DETAILED DESCRIPTION

Embodiments described in examples herein help to prevent soil contamination from flowback fluid by collecting the fluids in temporary storage containers, termed a fluid capture tank herein. The fluid capture tank will be mounted at the edge of a flare pit, and will be capable of capturing the returned fluid, while withstanding the high temperature of the flaring and flowback activity.

The fluid capture tank is mounted prior to starting the flowback operations on the ground of the pit. The horizontal flaring practice will not be changed or effected. The gases will continue to burn and the fluid will flow into an open top tank from a flare chute located under the flame or flare, at a pre-determined safe distance. The fluid will be sucked into a transportation tank, such as a vacuum truck, for further processing, such as recycling in a designated facility.

Figure 1:
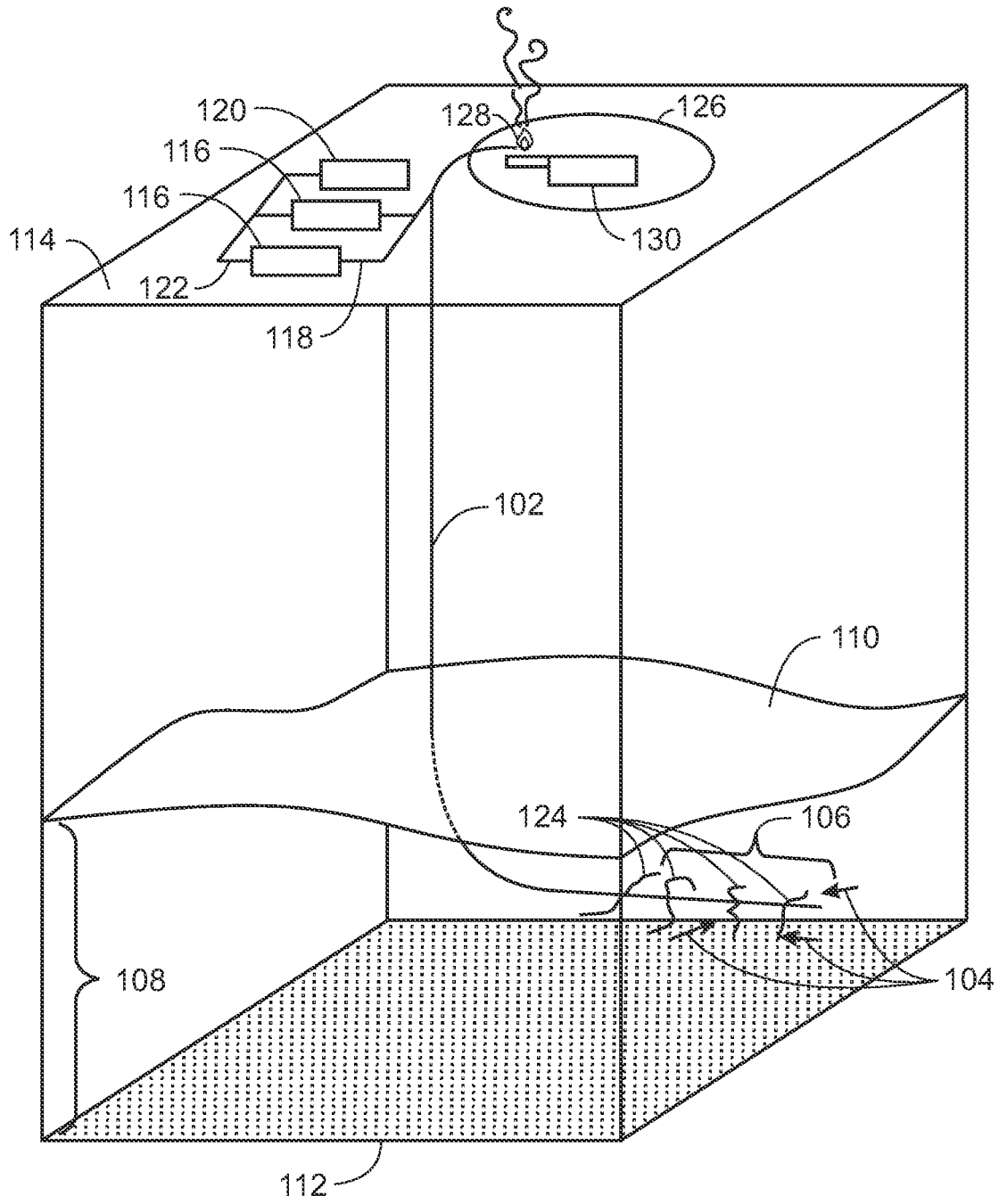
FIG. 1 is a schematic drawing of a wellbore, showing the flaring and capture of flowback fluid flowing back from a fractured region of a reservoir layer.

FIG. 1 is a schematic drawing 100 of a wellbore 102, showing the flaring and capture of flowback fluid 104 flowing back from a fractured region 106 of a reservoir layer 108. As shown, the fractured region 106 is between a cap rock layer 110 and a lower layer 112. The lower layer 112 may be an underlying water table or an impermeable layer of rock.

The wellbore 102 is drilled from the surface 114, and then used for fracturing operations in the fractured region 106. The fracturing operations are generally performed using high-pressure pumps 116 coupled by lines 118 to the wellbore 102. During the fracturing, liquid is pumped from liquid storage tanks 120 through lines 122 to the high-pressure pumps 116, and forced into the formation to create fractures 124. Proppant carried in the liquid is used to hold the fractures 124 open after pressure is released from the high-pressure pumps 116.

Once pressure is released from the high-pressure pumps 116, a portion of the fluid forced into the fractured region 106 returns to the surface as a flowback fluid 104. The flowback fluid 104 may be diverted to a burn pit 126 where hydrocarbons, such as gas, in the flowback fluid 104 are burned in a flame 128. However, in this configuration, nonflammable liquids in the flowback fluid 104 would land on the surface in the burn pit 126, potentially creating an environmental hazard. Although the contaminated surface materials may be removed, the extra cost associated with the cleanup may be substantial. Accordingly, examples described herein provide a fluid capture tank 130 that allows the hydrocarbons to be burned while capturing the nonflammable liquids for later disposal.

Figure 2:
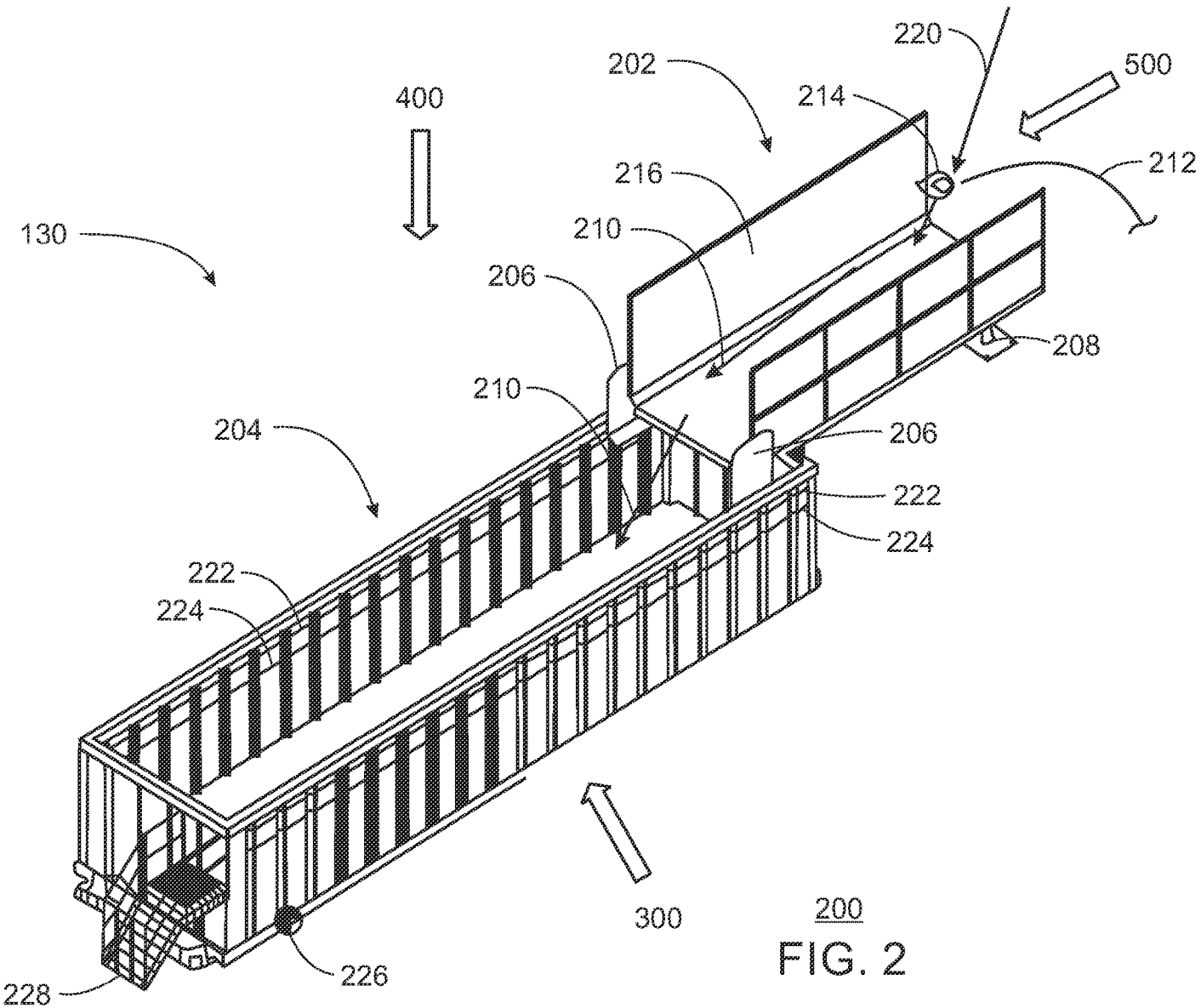
FIG. 2 is a perspective view of a fluid capture tank used to capture fluid during flowback or burning.

FIG. 2 is a perspective view of a fluid capture tank 200 used to capture fluid during flowback or burning. The fluid capture tank 200 includes a flare chute 202 and an open top tank 204 and. The flare chute 202 is mounted to the open top tank 204, for example, by pivot mounts 206. In some embodiments, the pivot mounts 206 allow the flare chute 202 to be pivoted into the open top tank 204 for repositioning, such as shipping to a new location. In these embodiments, stops 208 are mounted along the flare chute 202. The stops 208 rest on the sides of the open top tank 204, holding the flare chute 202 off the bottom of the open top tank 204, protecting it during shipping.

The flare chute 202 is formed from three panels, a bottom panel mounted to a left wall panel, and a right wall panel. As an example, the flare chute 202 may be about 6 m in length, 2.5 m wide and 1.7 m high. During use, the end of the flare chute 202 coupled to the pivot mounts 206 is lower than the opposite end of the flare chute 202, forming a slope that directs fluid 210 from a line 212 from a well such as flowback fluid, into the open top tank 204.

The line 212 ends in a flame 214, or flare, to burn off hydrocarbons, such as gas, entrained in the fluid. Accordingly, the flare chute 202 is coated with a refractory coating 216 to protect the three panels of the flare chute 202 from the flame 214. The refractory coating 216 may be formed from any number of materials that are resistant to high temperatures. In some embodiments, the refractory coating 216 is an alumina layer fused to the inner surfaces of the panels. In other embodiments, the refractory coating 216 is a refractory cement applied to the panels during manufacture. In other embodiments, ceramic bricks are used as the refractory coating 216.

As the hydrocarbon content of the fluid 210 may vary, an igniter 220 may be used to ignite any hydrocarbons in the fluid 210. The igniter 220 may be part of the flare chute 202, for example, being coupled to a power supply or a gas supply after the fluid capture tank 200 is positioned. In some embodiments, the igniter 220 is a continuously burning pilot flame. In other embodiments, the igniter 220 may include a hydrocarbon detector and a spark generator, wherein the spark generator is fired if the hydrocarbon detector detects hydrocarbons in the air around the fluid 210. In some embodiments, the igniter 220 is part of a horizontal flare system affixed to the end of the line 212.

In various embodiments, the open top tank 204 is a mobilized container, for example, 12 m long by 3 m wide by 2.3 m high, as this size may make the open top tank 204 more convenient for transportation over roadways. However, any number of dimensions may be used. The open top tank 204 may be made from carbon steel, and have a capacity of about 72,000 liters (L) for temporarily storing wastewater.

In some embodiments a wheel set, such as a single axis of two wheels or a dual axis of four wheels, may be mounted at one end of the open top tank 204 for transportation, for example, below the pivot mounts 206 for the flare chute 202. In these embodiments, a towing hitch may be mounted to the opposite end of the open top tank 204.

In various embodiments, the open top tank 204 has a filling limit marking 222 at 85% (380 BLL) of capacity, for example, marked with red color, and a pre-notification limit marking 224 at 65% (290 BLL) of capacity, for example, marked with yellow color. After filling the container of wastewater, a discharge valve 226, installed at the bottom of the open top tank 204 will allow a vacuum truck to pump out the fluid 210. In some embodiments, a backup valve is mounted in the side of the open top tank 204, for example, mounted above the discharge valve 226, to allow the fluid 210 to be pumped out if the discharge valve 226 is plugged, for example, with sludge from the fluid 210. In some embodiments, a staircase 228 is mounted to the open top tank 204 to provide access to the top of the open top tank 204. Clamps or a hose mount, may be installed at the top to allow a discharge hose to be mounted to the open top tank 204 to pump out the fluid 210, for example, as an emergency solution in case both valves are blocked.

Figure 3:
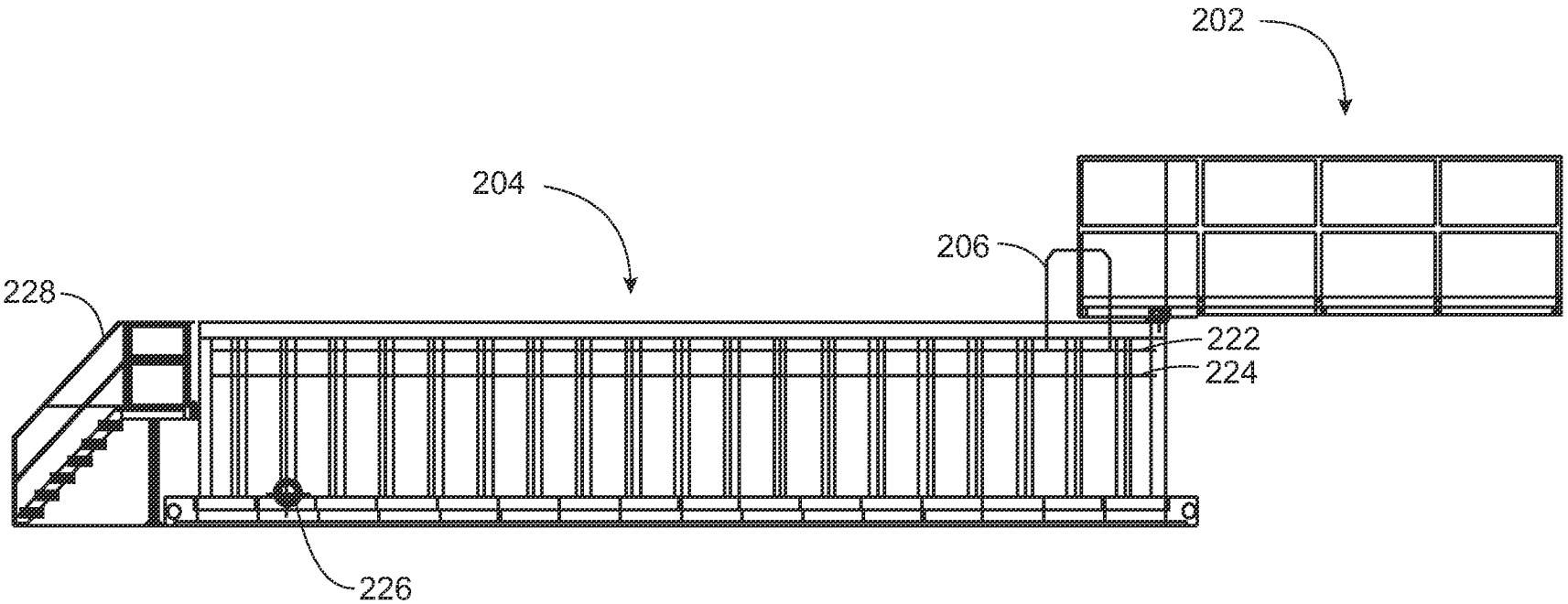
FIG. 3 is a side view of the fluid capture tank.

The following figures show additional views of the fluid capture tank 200. FIG. 3 is a side view 300, FIG. 4 is a top view 400, and FIG. 5 is an end view 500 from the end of the flare chute 202.

FIG. 3 is a side view 300 of the fluid capture tank 200. Like numbered items are as described with respect to FIG. 2.

Figure 4:
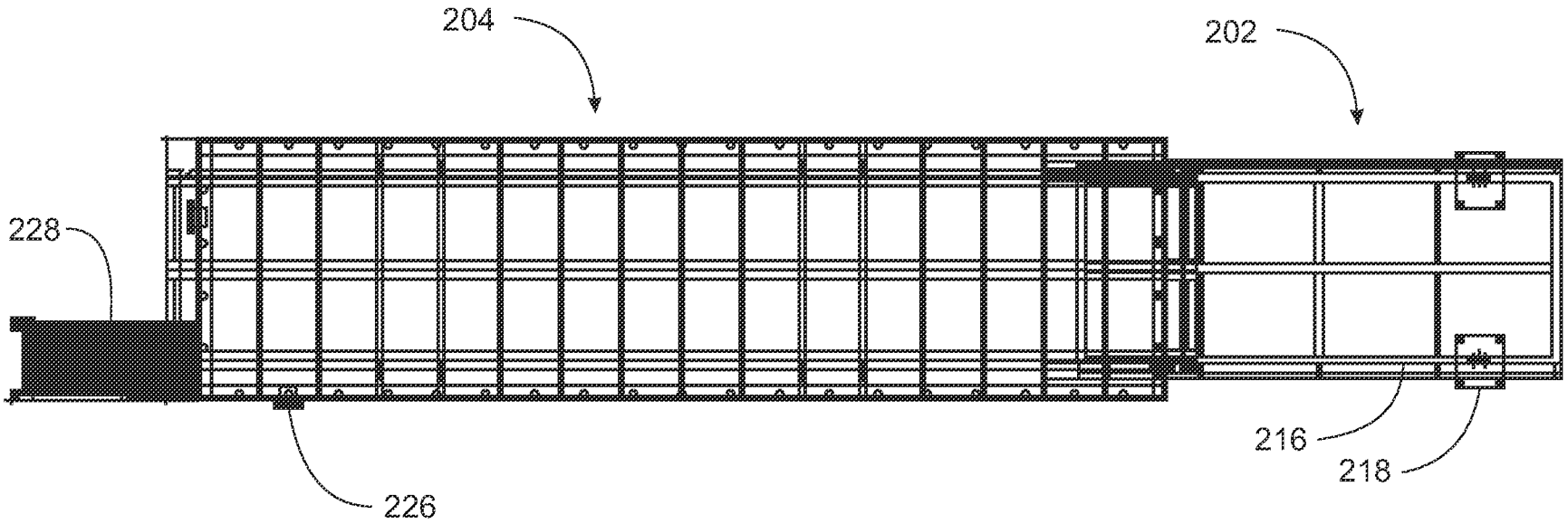
FIG. 4 is a top view of the fluid capture tank.

FIG. 4 is a top view 400 of the fluid capture tank 200. Like numbered items are as described with respect to FIG. 2.

Figure 5:
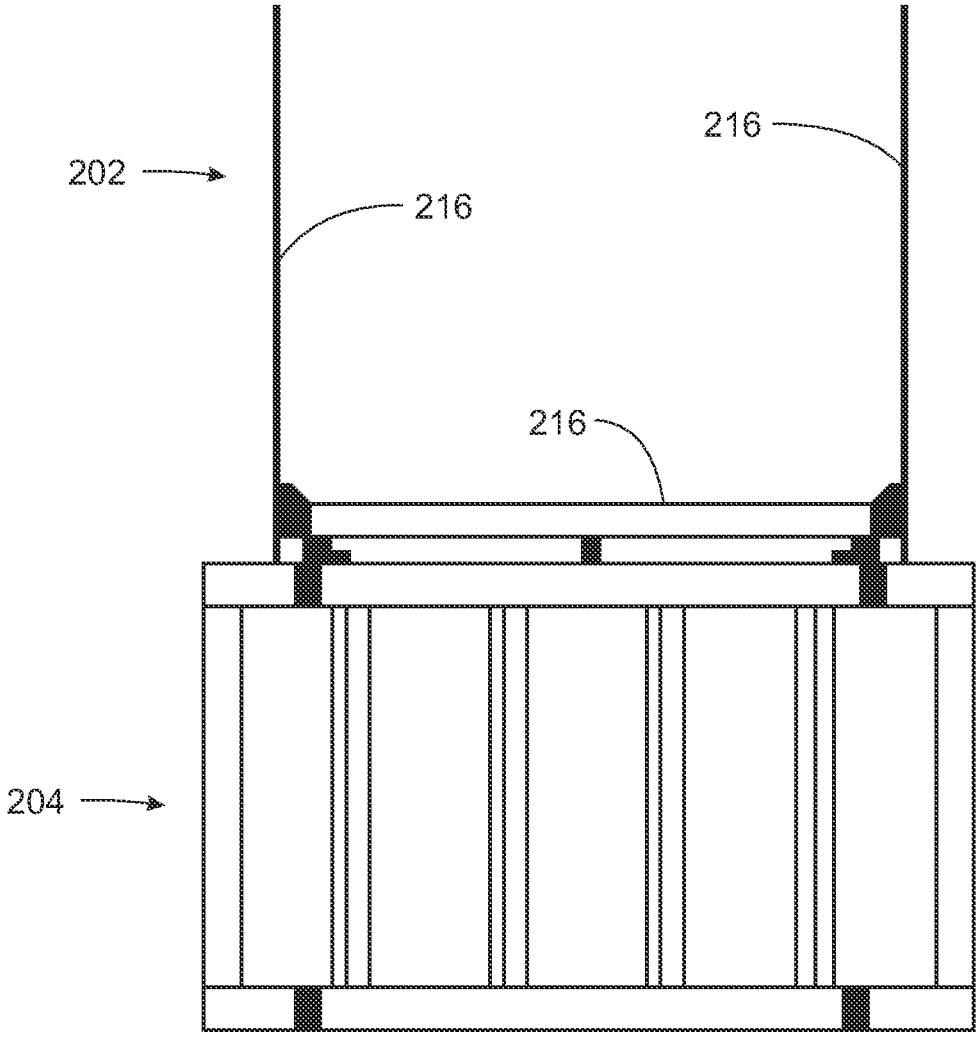
FIG. 5 is an end view of the fluid capture tank from the end of the flare chute.

FIG. 5 is an end view 500 of the fluid capture tank 200 from the end of the flare chute 202.

Figure 6:
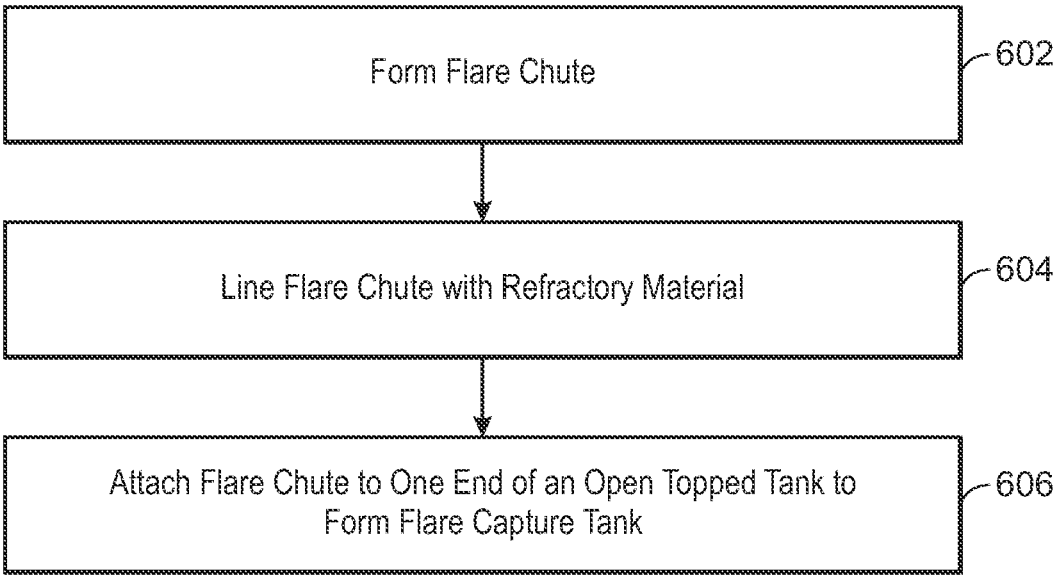
FIG. 6 is a process flow diagram of a method for forming a flare capture tank.

FIG. 6 is a process flow diagram of a method 600 for forming a flare capture tank. The method begins at block 602, with the formation of the flare chute. The flare chute may be formed by attaching left and right side panels to a bottom panel, forming a U-shaped construct. At block 604, the flare chute is lined with refractory material. This may be done by pretreating the surfaces to increase adhesion, for example, by rough ending the surfaces. In some embodiments, a refractory concrete is then sprayed over the surfaces. In other embodiments, a refractory alumina coating is applied as a powder coating to the surfaces, which is then fused to the surfaces.

At block 606, the flare chute is attached to one end of an open top tank to form the flare capture tank. This may be performed by attaching pivot mounts to the open top tank, then connecting the flare chute to the pivots using axle bolts. The pivot mounts may be positioned such that when the flare chute is in the open position, it is sloped downwards towards the open top tank to cause any fluid that falls into the flare chute to flow into the open top tank.

Figure 7:
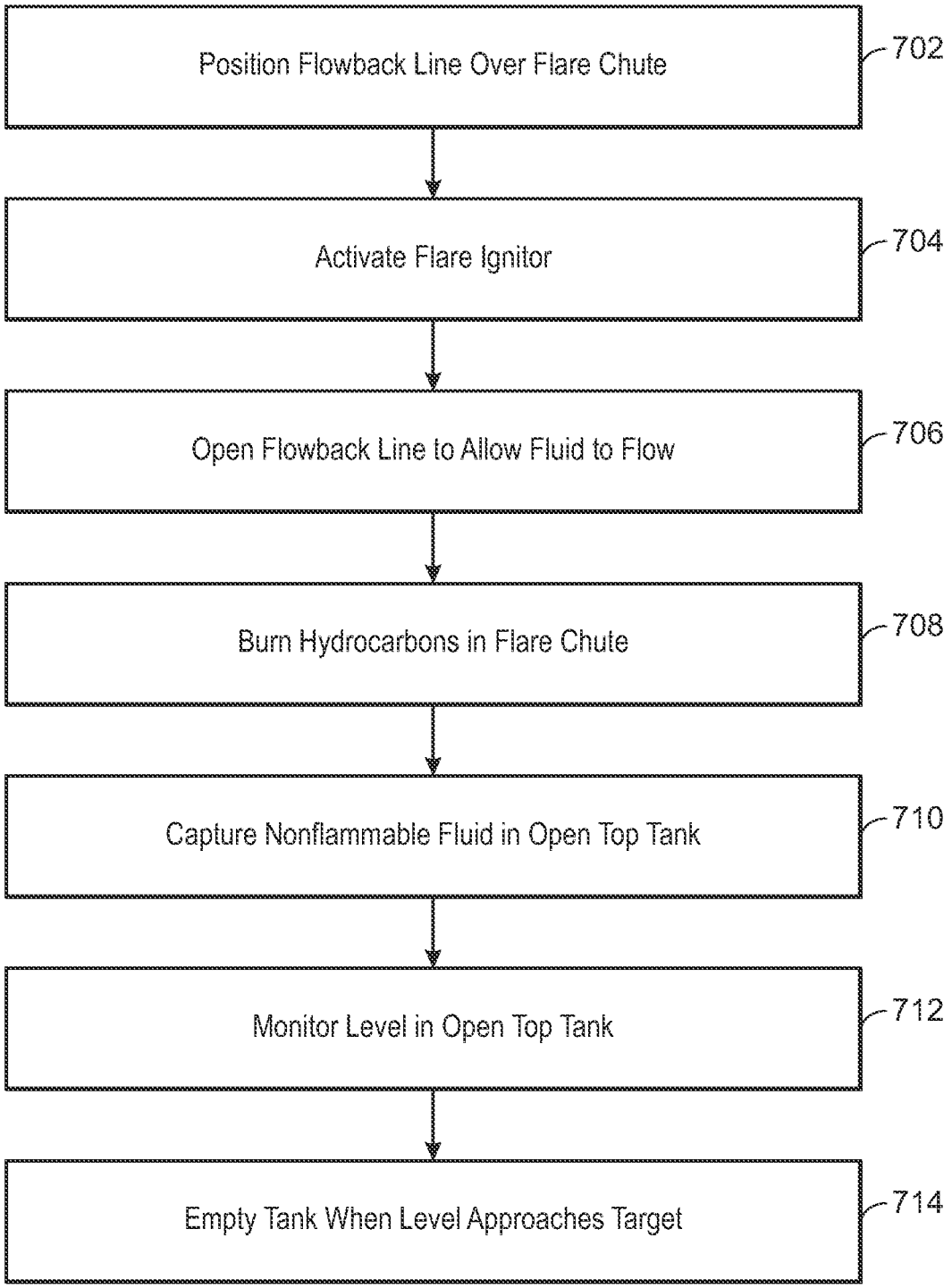
FIG. 7 is a process flow diagram of a method for using a fluid capture tank to capture fluid that includes flammable hydrocarbons.

FIG. 7 is a process flow diagram of a method 700 for using a fluid capture tank to capture fluid that includes flammable hydrocarbons. The method begins at block 702 when the outlet of the flowback line is positioned over the flare chute. If the flowback line is terminated in a horizontal flare tip, the horizontal flare tip is positioned over the flowback line.

At block 704, the flare igniter is activated. In some embodiments, the flare igniter is incorporated into a horizontal flare tip at the end of the flowback line. In other embodiments, the flare igniter is mounted to the edge of the flare chute and placed in proximity to the outlet of the flowback line. Activating the flare igniter may be performed by igniting a pilot flame, by activating a hydrocarbon detector/spark generator, or both.

At block 706, the flowback line is opened to allow fluid to flow from the outlet. As fluid flows from the outlet, at block 708, hydrocarbons are burned in the flare chute. Nonflammable fluid flows down the flare chute, and as described at block 710, is captured in the open top tank.

At block 712, the level of fluid in the open top tank is monitored. In some embodiments, this may be performed manually when an operator checks the level in comparison to the markings. In various embodiments, this may be performed by sensors, such as a camera mounted at the top of the stairs to monitor the tank, or a level sensor mounted in the tank, such as a float.

As described herein, the open top tank may have a full limit at 85% of capacity that is marked with a red color band around the inner surface of the open top tank. Further, a pre-notification limit at 65% of capacity marked with yellow color. At block 714, the tank may be emptied when the level approaches a target. For example, when the level reaches the pre-notification limit indicated by the yellow color, a vacuum truck may be coupled to the discharge valve to pump out the contents. If the discharge valve is plugged, for example, due to sludge in the fluid, the vacuum truck may be coupled to a backup valve. If that valve is plugged as well, the staircase may be used to access the top of the open top tank to mount a hose from a vacuum truck and pump the contents of the open top tank out from there.

Exemplary Embodiments

An exemplary embodiment described herein provides a fluid capture tank. The fluid capture tank includes an open top tank to hold fluid for disposal, and a flare chute mounted to one end of the open top tank. The flare chute includes three panels, including a bottom panel mounted to a left wall panel and a right wall panel, wherein the three panels direct fluid from a line into the open top tank. A refractory lining is disposed on an inner surface of at least one of the three panels facing the line, wherein the refractory lining protects the inner surface from heat as hydrocarbons in the fluid are burned.

In an aspect, the fluid capture tank includes a first marking along an interior surface of the open top tank to indicate a first fluid level. In an aspect, the first marking includes a yellow line.

In an aspect, the fluid capture tank includes a second marking along an interior surface of the open top tank to indicate a second fluid level. In an aspect, the second marking includes a red line.

In an aspect, the fluid capture tank includes a flare ignition system mounted in the flare chute. In an aspect, the flare ignition system includes a pilot flame.

In an aspect, the end of the flare chute that is mounted to the open top tank is lower than an opposite end of the flare chute, creating a slope into the open top tank. In an aspect, the refractory lining includes a refractory concrete.

In an aspect, a discharge valve is mounted in a sidewall of the open top tank. In an aspect, a backup discharge valve is mounted in a sidewall of the open top tank.

In an aspect, a stairway is mounted to the open top tank at an opposing end from the flare chute. In an aspect, a hose mount is disposed proximate to the stairway at an upper edge of the open top tank, wherein the hose mount is configured to hold a section hose for pumping out the fluid in the open top tank.

In an aspect, pivot mounts couple the open top tank to the flare chute, wherein the pivot mounts allow the flare chute to be swiveled into the open top tank for transportation. In an aspect, wheels are disposed at a base of the open top tank at the end at which the flare chute is mounted. In an aspect, a towing hitch is mounted to the open top tank at the opposite end from the flare chute.

Another exemplary embodiment described herein provides a method for making a fluid capture tank. The method includes forming a flare chute, wherein the flare chute is formed by coupling a bottom panel to a left side panel and coupling the bottom panel to a right side panel. The flare chute is lined with a refractory material. The flare chute is attached to one end of an open top tank to form the fluid capture tank.

In an aspect, the method includes attaching the flare chute to one end of the open top tank using pivot mounts attached to the open top tank. In an aspect, the method includes lining the flare chute with refractory concrete. In an aspect, the end of the flare chute attached to the open top tank is lower than an opposite end of the flare chute, creating a downward slope into the open top tank.

In an aspect, the method includes mounting a discharge valve in a side of the open top tank.

Another exemplary embodiment described herein method for using a fluid capture tank to capture fluids from a flowback operation. The method includes positioning a flowback line over a flare chute, wherein the flare chute is mounted at one end of an open top tank. The method includes activating a flare igniter, and opening the flowback line to allow fluid to flow. Hydrocarbons are burned in the flare chute and nonflammable fluid is captured in the open top tank.

In an aspect, the method includes monitoring a level of the fluid in the open top tank, and emptying the tank when the level reaches a target. In an aspect, the tank is empty by coupling a hose between a discharge valve on the open top tank and a vacuum truck, and sucking fluid from the open top tank into the vacuum truck.

In an aspect, the flare igniter is ignited by lighting a pilot flame. In an aspect, the flare igniter is activated by powering on a hydrocarbon detector, and activating a spark generator if hydrocarbons are detected.

Other implementations are also within the scope of the following claims.

What is claimed is:

1. A fluid capture tank, comprising:

an open top tank to hold fluid for disposal; and a flare chute mounted to one end of the open top tank, wherein the flare chute comprises three panels, comprising:

a bottom panel mounted to a left wall panel and a right wall panel wherein the three panels direct fluid from a line into the open top tank; and a refractory lining disposed on an inner surface of at least one of the three panels facing the line, wherein the refractory lining protects the inner surface from heat as hydrocarbons in the fluid are burned.

2. The fluid capture tank of claim 1, comprising a first marking along an interior surface of the open top tank to indicate a first fluid level.

3. The fluid capture tank of claim 2, wherein the first marking comprises a yellow line.

4. The fluid capture tank of claim 2, comprising a second marking along an interior surface of the open top tank to indicate a second fluid level.

5. The fluid capture tank of claim 4, wherein the second marking comprises a red line.

6. The fluid capture tank of claim 1, comprising a flare ignition system mounted in the flare chute.

7. The fluid capture tank of claim 6, wherein the flare ignition system comprises a pilot flame.

8. The fluid capture tank of claim 1, wherein the end of the flare chute that is mounted to the open top tank is lower than an opposite end of the flare chute, creating a slope into the open top tank.

9. The fluid capture tank of claim 1, wherein the refractory lining comprises a refractory concrete.

10. The fluid capture tank of claim 1, comprising a discharge valve mounted in a sidewall of the open top tank.

11. The fluid capture tank of claim 1, comprising a backup discharge valve mounted in a sidewall of the open top tank.

12. The fluid capture tank of claim 1, comprising a stairway mounted to the open top tank at an opposing end from the flare chute.

13. The fluid capture tank of claim 12, comprising a hose mount disposed proximate to the stairway at an upper edge of the open top tank, wherein the hose mount is configured to hold a section hose for pumping out the fluid in the open top tank.

14. The fluid capture tank of claim 1, comprising pivot mounts coupling the open top tank to the flare chute, wherein the pivot mounts allow the flare chute to be swiveled into the open top tank for transportation.

15. The fluid capture tank of claim 1, comprising wheels disposed at a base of the open top tank at the end at which the flare chute is mounted.

16. The fluid capture tank of claim 15, comprising a towing hitch mounted to the open top tank at the opposite end from the flare chute.

* * * * *